US008292751B2

(12) United States Patent
Adams

(10) Patent No.: US 8,292,751 B2
(45) Date of Patent: Oct. 23, 2012

(54) GRAVITY BOWLING GAME APPARATUS

(76) Inventor: Troy Elijah Adams, Daufuskie Island, SC (US)

( * ) Notice: Subject to any disclaimer, the term of this patent is extended or adjusted under 35 U.S.C. 154(b) by 62 days.

(21) Appl. No.: 12/761,407

(22) Filed: Apr. 16, 2010

(65) Prior Publication Data

US 2010/0267459 A1 Oct. 21, 2010

Related U.S. Application Data

(60) Provisional application No. 61/170,011, filed on Apr. 16, 2009.

(51) Int. Cl.
*A63F 3/00* (2006.01)

(52) U.S. Cl. ..... 473/113

(58) Field of Classification Search ..... 473/113
See application file for complete search history.

(56) References Cited

U.S. PATENT DOCUMENTS

| | | | | |
|---|---|---|---|---|
| 271,530 | A * | 1/1883 | Spang | 273/118 D |
| 1,106,859 | A * | 8/1914 | Ayers | 473/76 |
| 1,360,661 | A * | 11/1920 | Malone | 473/116 |
| 1,409,274 | A * | 3/1922 | Bech | 473/116 |
| 3,825,264 | A * | 7/1974 | Dockum | 273/126 R |
| 5,556,094 | A * | 9/1996 | Shiledar Baxi | 273/108.5 |
| 6,616,141 | B2 * | 9/2003 | Diamant | 273/108.1 |

* cited by examiner

*Primary Examiner* — William Pierce

(57) ABSTRACT

A new style of a bowling game where the ball can be maneuvered as it is rolling by force of gravity across the lane and toward the targets. The lane is divided into two parts that are connected to each other in a way that allows one part to be rotated and/or lifted while the other part that contains the targets can remain stationary.

12 Claims, 3 Drawing Sheets

GRAVITY BOWLING GAME APPARATUS

CROSS-REFERENCE TO RELATED APPLICATIONS

This nonprovisional patent is claiming the benefit of the invention disclosed in the provisional patent No. 61/170,011 that was filed on Apr. 16, 2009.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to a game apparatus that resembles a bowling game where a ball is used to roll across a surface and knock down targets that resemble bowling pins.

In the past, bowling style games have been made where some sort of device is used to shoot a ball across a surface referred to as a lane in order to knock down targets that resemble bowling pins. A player will usually line up the shooting device on the end of the lane opposite the bowling pins and then in some manner release the ball from the device. Once the ball leaves the shooting device, the ball cannot be maneuvered by the player. These games involve a single stationary lane where the bowling pins are set up at one end of the lane. Examples of this in prior art U.S. patents include the Livick U.S. Pat. No. 3,792,862 where a marble shooting device is used to shoot marbles across the lane and toward the bowling pins. In the Breslow et. al. U.S. Pat. No. 3,764,136 a ball propulsion device comprising an elastic band is used to shoot a ball across the lane. In the Maeda U.S. Pat. No. 3,756,598 a bowler figure with a spring arm is used for propelling a ball across the lane.

The present game relates to a new bowling style game where the ball can be maneuvered by the player as it is rolling across the lane and toward the targets. In this game, the lane is divided into two parts. One part of the lane remains stationary during game play and contains the targets that resemble bowling pins, and the other part of the lane can be rotated and/or lifted by the player. To make this possible, the two parts of the lane are connected to each other with a hinge in a way that allows one part of the lane to be rotated and/or lifted while the other part of the lane can remain stationary.

BRIEF SUMMARY OF THE INVENTION

A game apparatus has a housing that can be folded when not in use. In the open position, the game contains two flat surfaces aligned and connected to each other with a hinge that allows one of the flat surfaces to be rotated and/or lifted while the other flat surface remains stationary. The two surfaces that are joined together resemble a bowling lane with targets that resemble bowling pins set up on the surface that can remain stationary during game play.

To play the game, a ball is placed in a holding position on the surface that can be rotated and/or lifted. Next, the player will use the handles provided to get the ball rolling by force of gravity by moving the handles up and down. Moving the handles in opposite directions of each other, by moving one handle up and one handle down, will cause the surface to rotate, while lifting both handles up at the same time will cause the surface to be lifted. The player can continue to maneuver the ball by rotating and/or lifting the lane by use of the handles until the ball falls off the surface that can be rotated and/or lifted or is directed onto the surface that contains the targets. The object of the game is to try and knock down as many of the targets as possible with the ball.

DETAILED DESCRIPTION OF THE INVENTION

Figure 1:
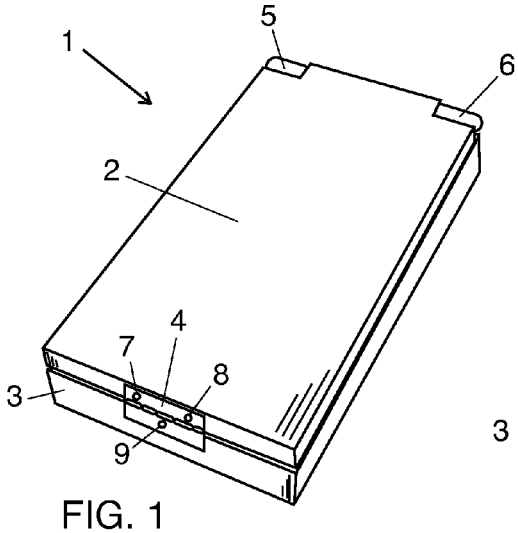
FIG. 1 shows a front elevated view of the game apparatus of the present invention in the folded closed position when the game is not being played.

As can be seen in FIG. 1 of the drawings, with the game in the folded closed position, a game apparatus 1 is shown having a housing member 2, a housing member 3, a hinge 4, a handle 5, a handle 6, a screw 7, a screw 8, and a screw 9. As shown more clearly in FIG. 2, the housing member 2 is attached to housing member 3 with the hinge 4, with the hinge 4 tightly attached to housing member 2 with the screw 7 and the screw 8, while the hinge 4 is loosely attached to housing member 3 with the single screw 9. There should be enough room between the hinge 4 and the bottom of housing member 3 so that the hinge 4 can easily rotate around the screw 9 when the game is being played.

Figure 3:
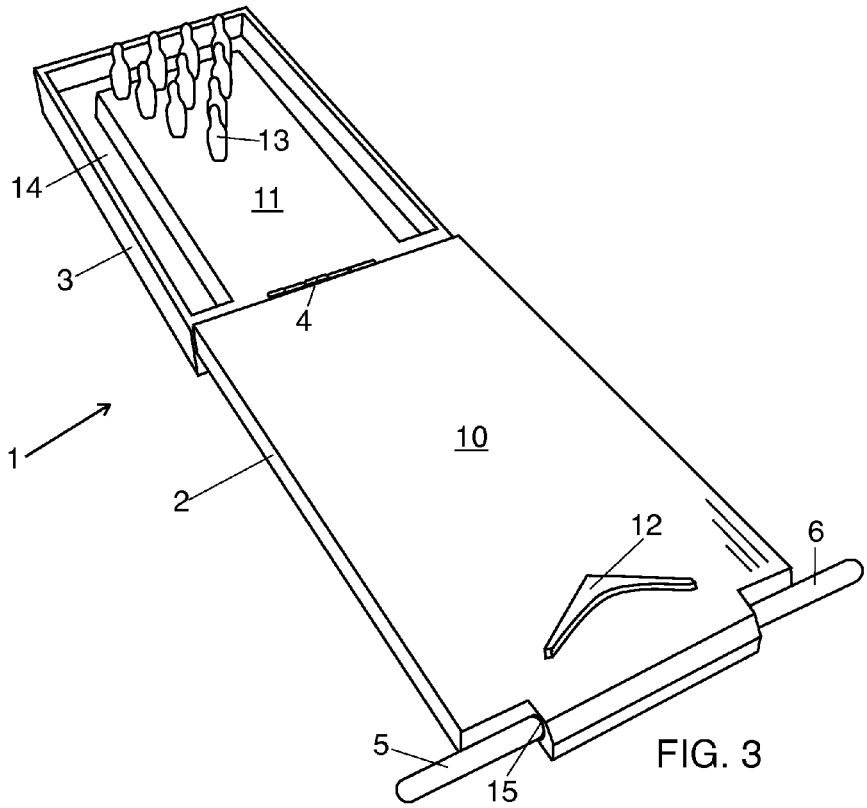
FIG. 3 shows a front elevated view of the game of FIG. 1 in the unfolded open position ready to be played.
Figure 4:
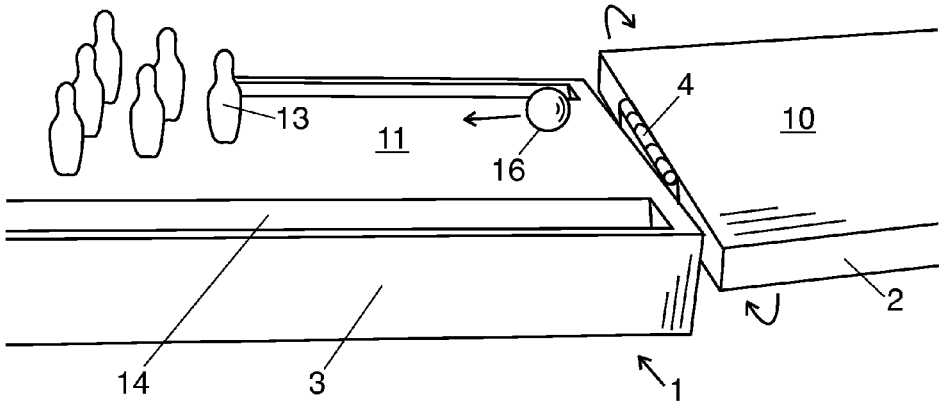
FIG. 4 shows a portion view of the side of the game of FIG. 1 in the unfolded open position after the part of the lane that can be rotated and/or lifted has been rotated.
Figure 5:
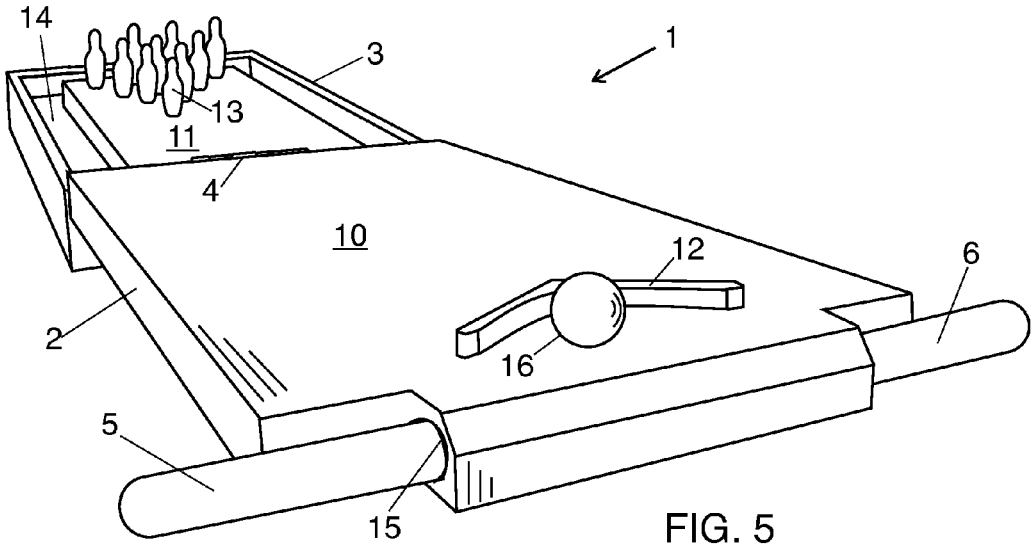
FIG. 5 shows a front perspective view of the game of FIG. 1 in the unfolded open position ready to be played.

In FIG. 3, with the game in the unfolded open position ready to be played, a flat surface 10 can be seen on housing member 2, and a flat surface 11 can be seen on housing member 3. In FIG. 3, FIG. 4, FIG. 5, FIG. 6 and FIG. 7 a recessed area 14 can be seen that extends around the sides and back of the flat surface 11. As shown in FIG. 3 and FIG. 5, the handle 5 and the handle 6 are loosely attached inside a hole 15 that extends through the front of housing member 2, therefore allowing the handles to easily slide inward and outward from the hole 15 as needed. As shown in FIG. 3, FIG. 5, FIG. 6 and FIG. 7 a ball holding element 12 is attached on and near the front of surface 10 of housing member 2. When the game is unfolded to the open position as shown in FIG. 3, FIG. 4, FIG. 5, FIG. 6 and FIG. 7 the flat surface 10 and the flat surface 11 become aligned so that a ball 16, as shown in FIG. 4, FIG. 5, FIG. 6 and FIG. 7 can easily move by force of gravity from surface 10 onto surface 11. The hinge 4 is attached in a position on housing member 2 so that the hinge 4 does not extend above the flat surface 10 when the game is in the unfolded opened position. The head of the screw 9 has enough thickness so that when the game is fully opened in the ready to play position the hinge 4 stops in a position that makes the front of housing member 2 that contains the handle 5 and handle 6 higher than the back of housing member 2 where the hinge 4 is attached.

Figure 6:
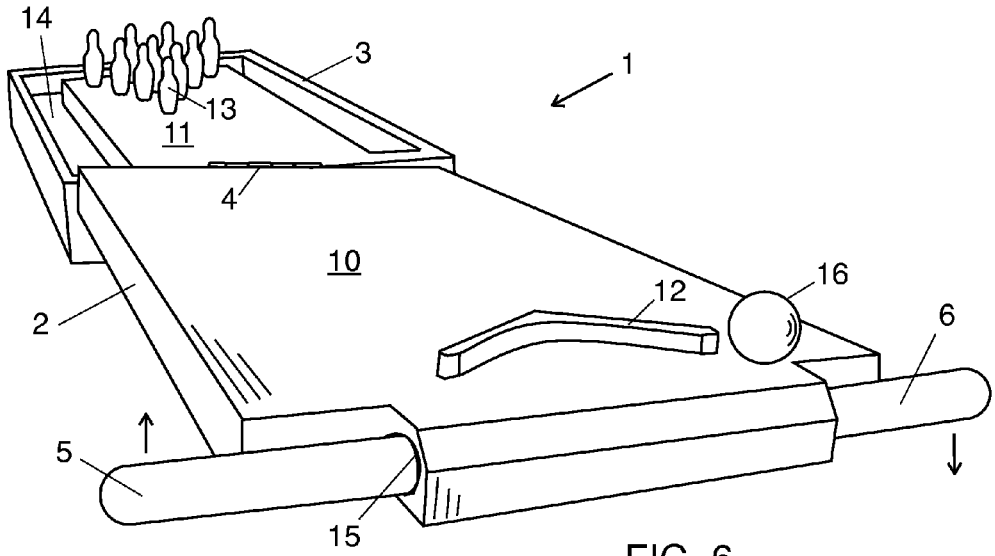
FIG. 6 shows a front perspective view of the game of FIG. 1 in the unfolded open position after the part of the lane that can be rotated and/or lifted has been rotated.
Figure 7:
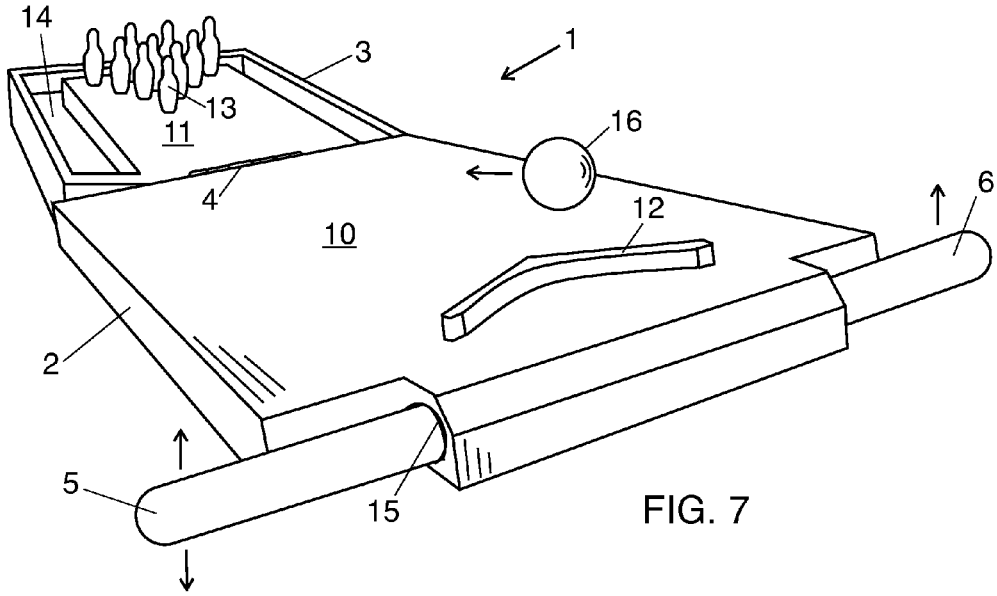
FIG. 7 shows a front perspective view of the game of FIG. 1 in the unfolded open position after the part of the lane that can be rotated and/or lifted has been rotated and lifted.

To use the game of FIG. 1, the game is set up to the fully unfolded open position ready to be played as shown in FIG. 3 and FIG. 5, with the housing member 2 in a level position and handle 5 and handle 6 extended outward from the hole 15. As seen in FIG. 3, FIG. 4, FIG. 5, FIG. 6 and FIG. 7 a plurality of targets 13 that resemble bowling pins are placed in an upright position on surface 11 of housing member 3. As seen in FIG. 5, a ball 16 is placed and held by gravity in a holding position in front of the ball holding element 12 on housing member 2. To start the ball 16 moving by force of gravity, the housing member 2 is rotated by moving handle 5 and handle 6. Once the ball 16 moves out and past the ball holding element 12 the ball 16 can continue to be maneuvered as it is moving by force of gravity across surface 10 by rotating and/or lifting housing member 2. Moving the handles in opposite directions of each other, by moving one handle up and the other handle down, will cause the housing member 2 to rotate. Lifting both handles up at the same time will cause the housing member 2 to be lifted from the front. FIG. 6 shows housing member 2 being rotated by moving handle 5 up and moving handle 6 down, causing the ball 16 to move out and past the ball holding element 12. FIG. 7 illustrates housing member 2 being rotated and lifted, by moving handle 5 down and handle 6 up, and then moving handle 5 and handle 6 up at the same time. Since the hinge 4 is tightly attached to housing member 2 with two screws and loosely attached to housing member 3 with a single screw, the housing member 2 can be rotated and/or lifted while the housing member 3 remains stationary, as shown in FIG. 4, FIG. 6 and FIG. 7. The object of the game described is to knock down as many of the targets 13 as possible with the ball 16.

FIG. 4 illustrates the movement of housing member 2 as it is being rotated, and shows the ball 16 that has already moved from surface 10 onto surface 11 and is heading toward the targets 13. FIG. 7 shows how the ball 16 is being maneuvered toward the middle of surface 10 by moving handle 5 down and handle 6 up.

Figure 2:
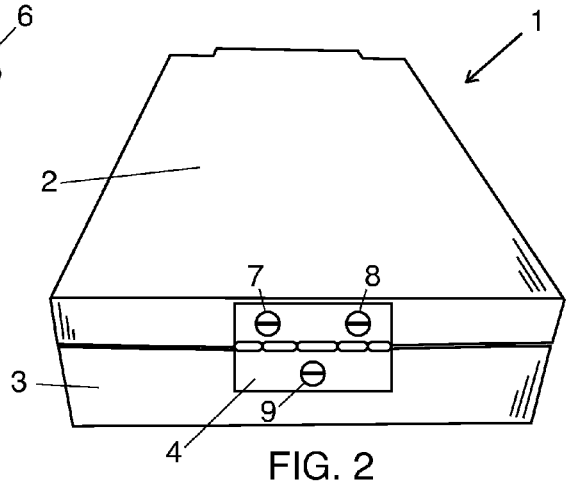
FIG. 2 shows a front perspective view of the game of FIG. 1 in the folded closed position.

A hinge is preferred to be used to connect housing member 2 and housing member 3 together, since a hinge allows the game apparatus to be folded and closed when not in use, as shown in FIG. 1 and FIG. 2. There are other ways of connecting housing member 2 and housing member 3 together without a hinge, that would still allow housing member 2 to rotate and/or lift while housing member 3 remains stationary. Therefore, the game should not be limited to the elements as shown, and the drawings should be considered illustrative rather than restrictive.

It should be clear at this time that a new style of a bowling game has been taught where the ball can be maneuvered as it is moving across the lane.

I claim:

1. A bowling game comprising:
a lane that is divided into two parts;
a game element;
where one part of the said lane can remain stationary while the other part of the said lane can be rotated and/or lifted;
where said game element can be maneuvered as it is moving by force of gravity on the one part of the said lane that can be rotated and/or lifted;
where targets are set up on the part of the said lane that can remain stationary;
where the two parts of the said lane are connected to each other with a hinge;
where said hinge is tightly connected with two screws to the part of the said lane that can be rotated and/or lifted,
and where said hinge is loosely connected with one screw to the part of the said lane that can remain stationary.

2. A bowling game in accordance with claim 1 where said targets resemble bowling pins.

3. A bowling game in accordance with claim 2 where said game element is a ball.

4. A game apparatus comprising:
a housing;
a game element;
where said housing is comprised of two housing members connected to each other in a way that allows one housing member to be rotated and/or lifted while the other housing member remains stationary;
where said game element can be maneuvered as it is moving by force of gravity on the housing member of the said housing that can be rotated and/or lifted;
where targets are set up on the housing member of the said housing that remains stationary;
where the two housing members of the said housing are connected to each other with a hinge;
where said hinge is tightly connected to the housing member of the said housing that can be rotated and/or lifted,
and where said hinge is loosely connected to the housing member of the said housing that remains stationary.

5. A game apparatus in accordance with claim 4 where said hinge is tightly connected with two screws to the housing member of the said housing that can be rotated and/or lifted,
and where said hinge is loosely connected with one screw to the housing member of the said housing that remains stationary.

6. A game apparatus in accordance with claim 5 where said targets resemble bowling pins.

7. A game apparatus in accordance with claim 6 where said game element is a ball.

8. A bowling game comprising:
a lane that is divided into two parts;
a game element;
where the two parts of the said lane are connected to each other in a way that allows one part of the said lane to rotate about two axis, or have two degrees of freedom, while the other part of the said lane remains stationary;
where said game element can be maneuvered as it is moving by force of gravity on the part of the said lane that can rotate about two axis,
and where targets are set up on the part of the said lane that remains stationary.

9. A bowling game in accordance with claim 8 where the two parts of the said lane are connected to each other with a hinge;
where said hinge is tightly connected to the part of the said lane that can rotate about two axis,
and where said hinge is loosely connected to the part of the said lane that remains stationary.

10. A bowling game in accordance with claim 9 where said hinge is tightly connected with two screws to the part of the said lane that can rotate about two axis,
and where said hinge is loosely connected with one screw to the part of the said lane that remains stationary.

11. A bowling game in accordance with claim 10 where said targets resemble bowling pins.

12. A bowling game in accordance with claim 11 where said game element is a ball.

* * * * *